United States Patent [19]

Yoshieda et al.

[11] Patent Number: 4,821,396

[45] Date of Patent: Apr. 18, 1989

[54] METHOD OF MANUFACTURING SEPARABLE SLIDE FASTENERS

[75] Inventors: Keiichi Yoshieda, Kurobe; Yuusei Sassa, Namerikawa; Toshiaki Sodeno, Toyama; Kunio Miyazaki, Uozu, all of Japan

[73] Assignee: Yoshida Kogyo K. K., Tokyo, Japan

[21] Appl. No.: 784,591

[22] Filed: Oct. 4, 1985

[30] Foreign Application Priority Data

Oct. 9, 1984 [JP] Japan ..... 59-211932

[51] Int. Cl.[4] ..... B21D 53/50; A41H 37/06

[52] U.S. Cl. ..... 29/410; 29/766; 29/769

[58] Field of Search ..... 29/33.2, 408–410, 29/766–770

[56] References Cited

U.S. PATENT DOCUMENTS

| | | | |
|---|---|---|---|
| 3,081,462 | 3/1963 | Radovsky et al. | 2/265 |
| 3,714,698 | 2/1973 | Fukuroi | 29/408 |
| 4,122,594 | 10/1978 | Azzara | 29/768 |
| 4,131,993 | 1/1979 | Azzara | 29/768 |
| 4,332,071 | 6/1982 | Takahashi | 29/767 |
| 4,368,570 | 1/1983 | Morita | 29/767 |
| 4,494,293 | 1/1985 | Kawakami | 29/766 |
| 4,495,695 | 1/1985 | Umino | 29/767 |
| 4,580,326 | 4/1986 | Kawakami et al. | 29/766 |

FOREIGN PATENT DOCUMENTS

| | | |
|---|---|---|
| 49-44243 | 11/1974 | Japan . |
| 58-50721 | 11/1983 | Japan . |

*Primary Examiner*—Carl E. Hall

*Attorney, Agent, or Firm*—Hill, Van Santen, Steadman & Simpson

[57] ABSTRACT

Separable slide fasteners are manufactured from an alongate slide fastener chain composed of a pair of slide fastener stringers having rows of coupling elements alternating with element-free portions having substantially U-shaped recesses defined in inner edges thereof. The elongate slide fastener chain is fed under tension along a longitudinal path, and the slide fastener stringers are separated from each other. Then, an insertion pin is attached laterally to the inner edge of one of the element-free portions, and a box pin is attached laterally to the inner edge of another element-free portion confronting said one element-free portion. The insertion pin and the box pin which are laterally aligned with each other are threaded through a slider until certain coupling elements of the slide fasteners stringers are interengaged. Then, a box is attached to the box pin. An elongate product composed of joined separable slide fasteners may be sewn to successive garment fabrics, or may be cut off into individual separable slide fasteners.

4 Claims, 5 Drawing Sheets

METHOD OF MANUFACTURING SEPARABLE SLIDE FASTENERS

BACKGROUND OF THE INVENTION

1. Field of the Invention

The present invention relates to a method of producing separable slide fasteners from an elongate slide fastener chain, and more particularly to a method of finishing separable slide fasteners so as to be produced either individually or as an elongate product composed of such separable slide fasteners joined end to end.

2. Description of the Prior Art

Generally, there are known three methods of manufacturing separable slide fasteners from an elongate slide fastener chain. One of the known methods is disclosed in U.S. Pat. No. 3,081,462. According to the disclosed method, the separable slide fasteners are produced as an elongate joined product for allowing them to be sequentially sewn to garments highly efficiently. More specifically, slits are formed at element-free portions in an elongate slide fastener chain, and insertion pins, box pins, sliders, and boxes are manually attached to the chain through the slits.

The other two methods are directed to the fabrication of separable slide fasteners as individual product units. According to one method which is shown in Japanese Patent Publication No. 49-44243, a slider and a box integral with a box pin are attached to one of a pair of separate slide fastener stringers through the leading end thereof, whereas an insertion pin is attached to the other slide fastener stringer at the leading end thereof. Thereafter, the slide fastener stringers are cut off to prescribed lengths, which are then manually combined into a separable slide fastener. Japanese Patent Publication No. 58-50721 reveals the other method in which insertion and box pins are attached to the leading ends of two slide fastener stringers, and a slider is threaded over the stringers to interengage some coupling elements. With the insertion and box pins aligned with each other, a box is fitted over the pins and fixed to the box pin. Thereafter, the slide fastener stringers are severed into a unit fastener product.

The conventional method for producing an elongate piece of joined separable slide fasteners is primarily performed manually, and hence the manufactured separable slide fasteners are apt to be irregular in quality. The manual process is poor in efficiency. In the two methods of manufacturing individual separable slide fastener sliders, the box and insertion pins cannot be attached properly if the severed leading ends of the slide fastener stringers are improperly shaped or otherwise deformed. These two methods have been unsatisfactory in the mass-production of uniform separable slide fasteners.

SUMMARY OF THE INVENTION

It is an object of the present invention to provide a method of manufacturing separable slide fasteners uniformly as either individual product units or as an elongate product composed of such separable slide fasteners that are joined end to end.

According to the present invention, separable slide fasteners are manufactured from an elongate slide fastener chain composed of a pair of slide fastener stringers having rows of coupling elements alternating with element-free portions having substantially U-shaped recesses defined in inner edges thereof. The elongate slide fastener chain is fed under tension along a longitudinal path, and the slide fastener stringers are separated from each other. Then, an insertion pin is attached laterally to the inner edge of one of the element-free portions, and a box pin is attached laterally to the inner edge of another element-free portion confronting said one element-free portion. The insertion pin and the box pin which are laterally aligned with each other are threaded through a slider until certain coupling elements of the slide fastener stringers are interengaged. Then, a box is attached to the box pin. The above process is repeated to produce an elongate product composed of joined separable slide fasteners which may be sewn to successive garment fabrics, or may be cut off into individual separable slide fasteners. The method of the present invention can produce successive separable slide fasteners of uniform quality, and can easily be automatized.

Many other advantages and features of the present invention will become manifest to those versed in the art upon making reference to the detailed description and the accompanying sheets of drawings in which a preferred embodiment incorporating the principles of the present invention is shown by way of illustrative example.

DETAILED DESCRIPTION

Figure 1:
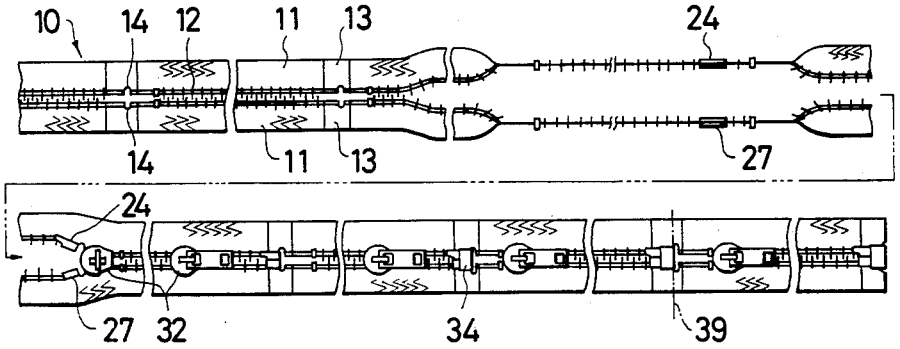
FIG. 1 is a fragmentary plan view showing the manner in which various separable slide fastener parts are successively attached to an elongate slide fastener chain in a method of automaticaly finishing separable slide fasteners according to the present invention.

As shown in FIG. 1, an elongate slide fastener chain 10 to be finished into separable slide fasteners according to a method of the present invention is composed of a pair of slide fastener stringers 11, 11 having intermeshing rows of coupling elements 12 alternating with element-free portions 13. Each of the element-free portions 13 is reinforced with a stiffening web such as a ribbon-like fabric lined with an adhesive layer or a film of synthetic resin. The slide fastener stringers 11, 11 have substantially U-shaped recesses or slots 14 defined respectively centrally in the element-free portions 13 and opening at inner confronting edges of the slide fastener stringers 11, 11.

Figure 3:
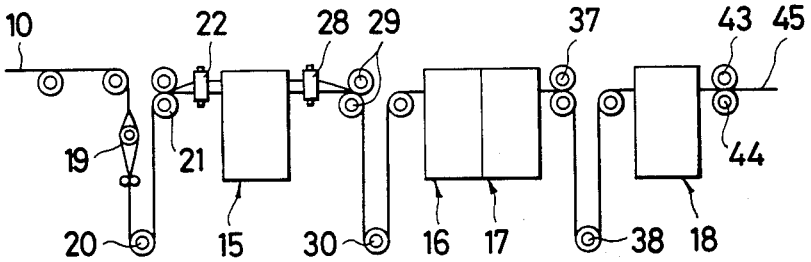
FIG. 3 is a schematic side elevational view of a system for carrying out an automatic finishing method according to the present invention.

FIG. 3 shows a system for automatically finishing separable slide fasteners. The system generally includes a pin applicator 15, a slider attachment device 16, and a box applicator 17 for automatically manufacturing an elongate product composed of joined separable slide fasteners. The system also has a cutter 18 for cutting off the elongate product into a plurality of separable slide fasteners of individual lengths.

Figure 1A:
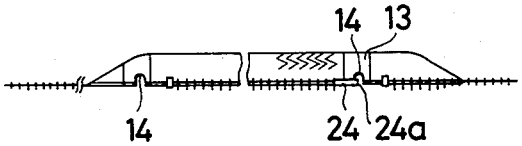
FIG. 1A is a side elevational view of a slide fastener stringer which is twisted through an angle of 90°.
Figure 4:
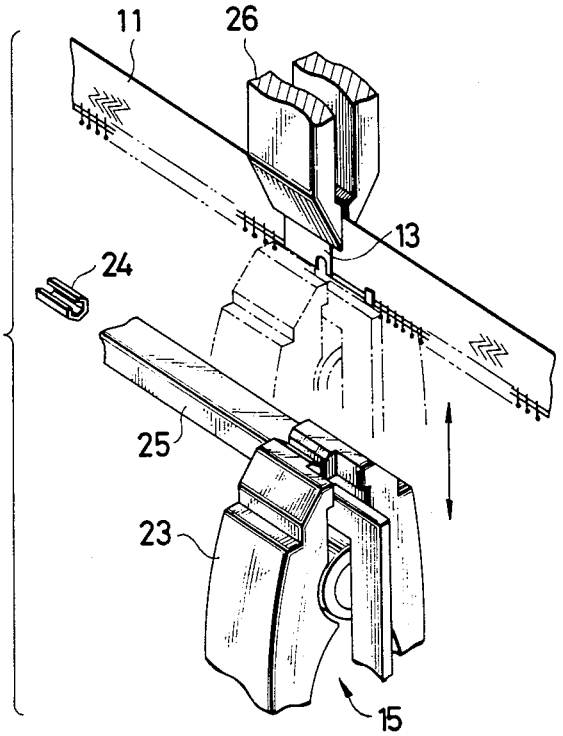
FIG. 4 is a perspective view illustrative of the manner in which an insertion pin is attached to a slide fastener stringer.

More specifically, the slide fastener chain 10 supplied from a roll (not shown) is separated by a separation roller 19 into the slide fastener stringers 11, 11 which are then tensioned by a tensioning roller 20. The tensioned slide fastener stringers 11 are independently twisted through an angle of 90° by guide rollers 21, 22 into vertical positions so that the rows of coupling elements 12 are directed downwardly, and are guided into the pin applicator 15. As shown in FIG. 4, the pin applicator 15 has an insertion-pin holder 23 vertically movably disposed below one of the slide fastener stringers 11 for holding an insertion pin 24 fed through a feed chute 25. When one of the element-free portions 13 on said one slide fastener stringer 11 arrives at an attachment position directly above the insertion-pin holder 23, the slide fastener stringer 11 is gripped by a stringer gripper 26 and the insertion-pin holder 23 is elevated toward the dot-and-dash-line position near the inner longitudinal edge of the slide fastener stringer 11 across the element-free portion 13. The insertion pin 24 held by the insertion-pin holder 23 is fitted transversely over the inner edge of the element-free portion 13 and clinched thereon by the insertion-pin holder 23. The attached insertion pin 24 is substantially aligned with the row of coupling elements 12 and has one end 24*a* projecting slightly into the recess 14 as shown in FIG. 1A. The pin applicator 15 also has a box-pin holder which is of the same structure as that of the insertion-pin holder 23. The box-pin holder is disposed below the other slide fastener stringer 11 for holding a box pin 27 (FIG. 1) supplied down another feed chute. The box pin 27 is attached to the element-free portion 13 of the other slide fastener stringer 11 in the same manner as the insertion pin 24. The insertion pins 24 and the box pins 27 are therefore successively attached to the respective element-free portions 13 of the elongate slide fastener chain 10. Since the slide fastener stringers 11, 11 are tensioned by the tensioning roller 20, the insertion pins 24 and the box pins 27 can accurately be applied laterally to the element-free portions 13.

Figure 5:
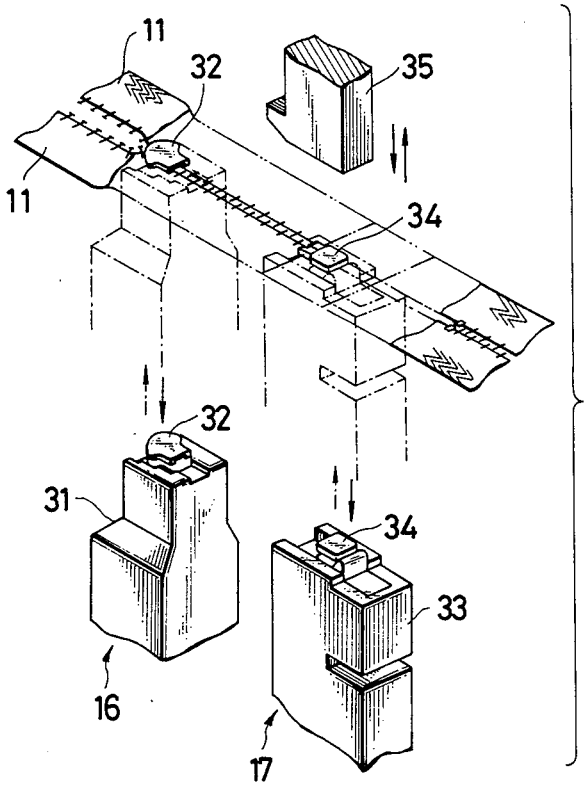
FIG. 5 is a perspective view showing the manner in which a slider and a box pin are attached to slide fastener stringers.

After the insertion pin 24 and the box pin 27 have been applied, the slide fastener stringers 11 are guided by guide rollers 28 and turned back to their horizontal positions by guide rollers 29. Then, the slide fastener stringers 11 are tensioned by a tensioning roller 30 and delivered into the slider attachment device 16. As illustrated in FIG. 5, the slider attachment device 16 has a slider holder 31 vertically movably disposed below the path of slide fastener stringers 11, 11 for supporting a slider 32 thereon. When the element-free portions 13 with the insertion and box pins 24, 27 attached thereto reach a slider attachment position immediately above the slider holder 31, the slider holder 31 is moved upwardly toward the dot-and-dash-line position for positioning the slider 32 between the element-free portions 13, 13 of the slide fastener stringers 11, 11. The rows of coupling elements 12 of the slide fastener stringers 11, 11 are guided along the grooves defined in a guide plate (not shown) to thread the insertion and box pins 24, 27 that are laterally aligned with each other and the following coupling elements 12 into the Y-shaped guide channel in the slider 32 through its throats until some coupling elements 12 are interengaged. When the leading ends of the insertion and box pins 24, 27 enter the slider 32, the U-shaped recesses 14 prevent the element-free portions 13 from being caught in the slider 32. At the same time, the U-shaped recesses 14 allow the element-free portions 13 to flex to direct the insertion and box pins 24, 27 smoothly into the Y-shaped guide channel in the slider 32. Accordingly, the pins 24, 27 can smoothly and easily be inserted into the slider 32. Thereafter, the slider 32 is released from the slider holder 31. Therefore, the slider 32 can then be fed with the slide fastener stringers 11.

Figure 6:
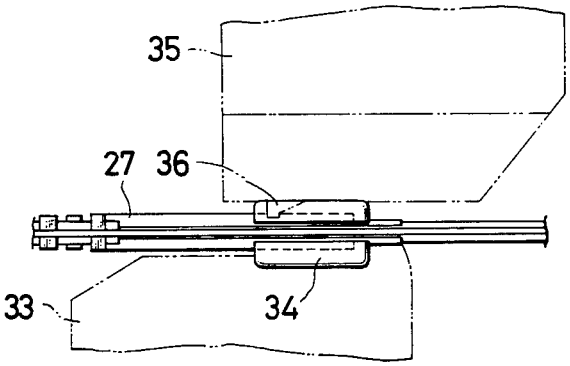
FIG. 6 is a side elevational view showing the manner in which a locking prong is formed on a box.

The slide fastener stringers 11 are thereafter fed to the box attachment device 17. As illustrated in FIG. 5, the box attachment device 17 has a box holder 33 vertically movably disposed below the path of slide fastener stringers 11, 11 for supporting a box 34 thereon. Upon arrival of the element-free portions 13 with the insertion and box pins 24, 27 attached thereto at a box attachment position immediately above the box holder 33, the box holder 33 is moved upwardly toward the dot-and-dash-line position for positioning the box 34 between the element-free portions 13, 13 of the slide fastener stringers 11, 11. As the slide fastener stringers 11, 11 are fed, the leading ends of the insertion and box pins 24, 27 are inserted into the box 34, at which time the insertion and box pins 24, 27 are laterally aligned with each other. Then, a vertically movable punch 35 disposed above the path of the stringers 11 substantially in vertical alignment with the box holder 33 is moved downwardly to engage the box 34. The punch 35 is lowered until a locking prong 36 is formed thereby on the box 34 and forced into biting engagement with the box pin 27, as shown in FIG. 6. The box 34 is now firmly anchored on the box pin 27. The recesses 14 prevent the element-free portions 13 from being entangled into the box 34 as it is secured to the box pin 27.

The slide fastener stringers 11, 11 are then fed via guide rollers 37 and a tensioning roller 38 into the cutter 18 which severs the slide fastener stringers 11, 11 along a line 39 (FIG. 1) across the element-free portions 13. The cutter 18 is required for cutting off the elongate slide fastener stringers 11, 11 into a plurality of separable slide fasteners. However, the cutter 18 may be dispensed with if an elongate separable slide fastener is to be produced.

Figure 2:
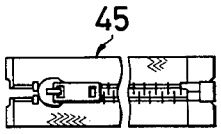
FIG. 2 is a plan view of a separable slide fastener of a unit length.
Figure 7:
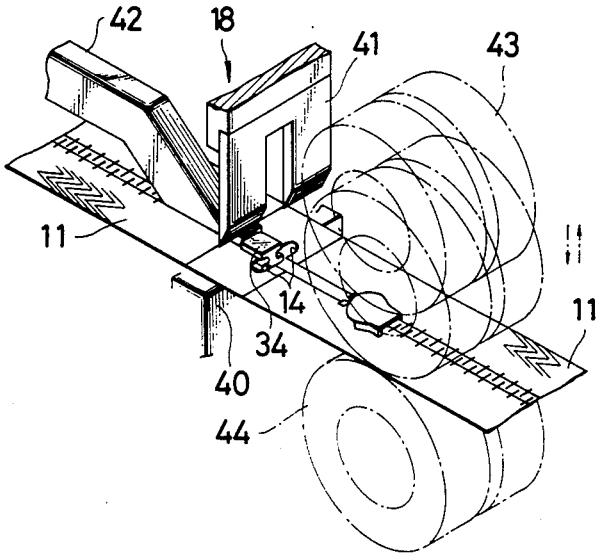
FIG. 7 is a fragmentary perspective view of the slide fastener stringers as they are gripped and released by feed rollers.
Figure 8:
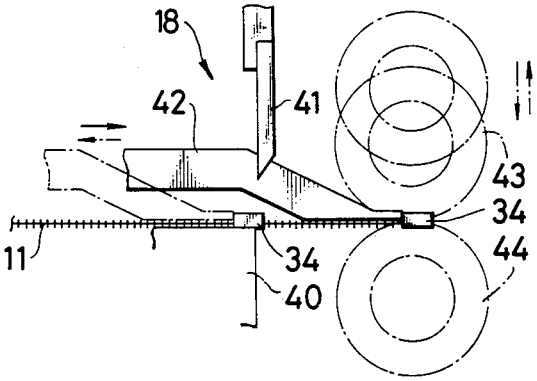
FIG. 8 is a fragmentary perspective view of the slide fastener stringers as they are advanced by a pusher.
Figure 9:
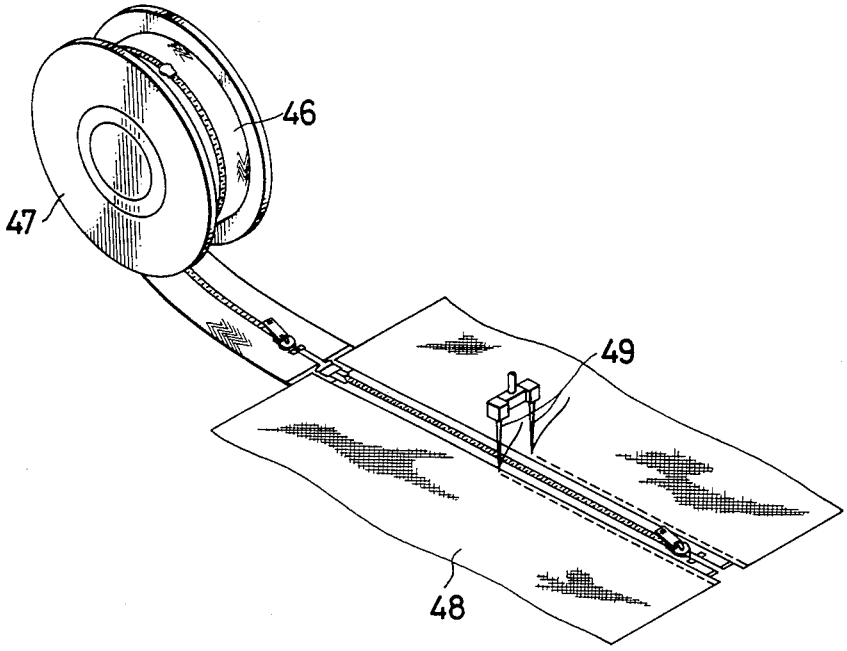
FIG. 9 is a perspective view of an elongate piece of joined separable slide fasteners which is supplied from a roll and sewn to a garment.

As shown in FIGS. 7 and 8, the cutter 18 includes a lower cutter die 40 and an upper cutter blade 41 held substantially in vertical alignment with each other, the upper cutter blade 41 being vertically movable toward and away from the lower cutter die 40. The cutter 18 also has a pusher 42 disposed upstream of the lower cutter die 40 and the upper cutter blade 41 along the path of the slide fastener stringers 11, 11. The pusher 42 is movable along the path of the slide fastener stringers 11, 11 for pushing the box 34 beyond the lower cutter die 40 and the upper cutter blade 41. Downstream of the lower cutter die 40 and the upper cutter blade 41, there is positioned a pair of upper and lower feed rollers 43, 44, the upper feed roller 43 being movable toward and away from the lower feed roller 44. When the element-free portions 13 reach a cutting position between the lower cutter die 40 and the upper cutter blade 41, the upper feed roller 43 is moved upwardly away from the lower feed roller 44 to release the slide fastener stringers 11, 11. The slide fastener stringers 11, 11 are now stopped and relieved of their longitudinal tension. Then, the upper cutter blade 41 is lowered to sever the element-free portions 13 along the straight line 39 on the lower cutter die 40, thereby producing a separable slide fastener 45 as shown in FIG. 2. The produced separable slide fastener 45 is then discharged by the feed rollers 43, 44 coacting with each other. The pusher 42 is actuated to move the following slide fastener stringers 11, 11 toward the feed rollers 43, 44, which engage and feed the slide fastener stringers 11, 11 down the path thereof until the next element-free portions 13 arrive at the cutting position.

Where the cutter 18 is employed, a succession of independent separable slide fasteners 45 (FIG. 2) can be produced. Where the cutter 18 is dispensed with, an elongate product 46 (FIG. 9) of joined separable slide fasteners can be manufactured. The elongate product 46 may be wound around a bobbin 47 and put on the market. The purchaser who bought the elongate product 46 can sew it successively to garment fabrics 48 with two sewing machine needles 49, and then cut off the sewn product 46 into individual separable slide fasteners which have already been stitched to the garment fabrics 48. Alternatively the elongate product 46 may be cut off into a desired number or length of separable slide fasteners upon customer's demand at a retail store. The elongate fastener product 46 as wound on the bobbin 37 can be more easily inventoried in factories and retail stores than the individual separable slide fasteners.

With the arrangement of the present invention, the various separable slide fastener parts such as insertion pins, box pins, sliders, and boxes can accurately be attached to slide fastener stringers. The method of the invention can easily be automated as a process of successive steps for producing an elongate product of joined separable slide fasteners.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A method of automatically manufacturing separable slide fasteners from an elongate side fastener chain composed of a pair of slide fastener stringers having rows of coupling elements alternating with element-free portions having substantially U-shaped recesses in inner edges thereof, said method comprising the steps of:

(a) feeding the elongate slide fastener chain under tension along a longitudinal path;

(b) separating the pair of slide fastener stringers from each other;

(c) twisting the separated slide fastener stringers independently through an angle of substantially 90° in said longitudinal path so that the inner edges of the slide fastener stringers are directed downwardly;

(d) attaching an insertion pin to the downwardly directed inner edge of one of said element-free portions of one of the twisted slide fastener stringers by moving the insertion pin perpendicularly to the inner edge to fit the pin transversely over the inner edge and then clinching the pin thereon;

(e) attaching a box pin to the downwardly directed inner edge of a corresponding element-free portion of the other twisted slide fastener stringer by moving the box pin perpendicularly to the other inner edge to fit the box pin transversely over the other inner edge and then clinching the box pin thereon;

(f) retwisting the twisted slide fastener stringers independently through an angle of substantially 90° in said longitudinal path so that the inner edges of the slide fastener stringers face each other;

(g) threading said insertion pin and said box pin through a slider until certain coupling elements of the slide fastener stringers are interengaged; and (h) finally, attaching a box to said box pin with said insertion pin inserted into said box.

2. A method according to claim 1, including the step of repeating said steps to produce an elongate product of joined separable slide fasteners.

3. A method according to claim 2, including the step of cutting off said elongate product into a plurality of individual separable slide fasteners.

4. A method according to claim 1, wherein the leading ends of said insertion and box pins are inserted into said box before the box is attached to said box pin.

* * * * *